US005312135A

United States Patent [19]

Karabees

[11] Patent Number: 5,312,135

[45] Date of Patent: May 17, 1994

[54] BRAKING AND STABILIZING SYSTEM FOR ROLLER BLADES

[76] Inventor: James P. Karabees, P.O. Box 113, Chilmark, Mass. 02535

[21] Appl. No.: 907,702

[22] Filed: Jul. 1, 1992

[51] Int. Cl.[5] ..... A63C 17/28

[52] U.S. Cl. ..... 280/826; 280/11.2; 280/809; 280/819; 135/85

[58] Field of Search ..... 280/11.2, 8, 11.26, 280/78, 809, 814, 819, 826; 135/65, 70, 77, 85; 188/19, 20

[56] References Cited

U.S. PATENT DOCUMENTS

| | | | |
|---|---|---|---|
| 339,786 | 4/1886 | Kayes | 280/826 |
| 1,589,491 | 6/1926 | Soderholm | 280/826 |
| 1,608,238 | 11/1926 | Riefschnider | 280/826 |
| 1,981,317 | 11/1934 | Jaglowicz | 280/826 |
| 2,027,388 | 1/1936 | Larkin | 280/826 |
| 2,148,644 | 2/1939 | Riefschnider | 280/826 |
| 4,018,449 | 4/1977 | Anderson | 188/19 |

*Primary Examiner*—Robert J. Oberleitner
*Assistant Examiner*—Clifford T. Bartz
*Attorney, Agent, or Firm*—Lyman R. Lyon

[57] ABSTRACT

A braking and stabilizing system for use by a roller blade skater comprises an elongated shaft adapted to be manually held by the skater and having a roller on at least one end thereof adapted to be biased against a skating surface and a brake mechanism controllable by the skater for braking rotation of the roller.

3 Claims, 1 Drawing Sheet

BRAKING AND STABILIZING SYSTEM FOR ROLLER BLADES

BACKGROUND OF THE INVENTION

The sport of roller blading was created by off season hockey players as a means of maintaining physical condition. The sport has rapidly gained in popularity and is now enjoyed by skaters of all degrees of athletic ability. A corollary to the increase in popularity of roller blading is an advance in roller blade technology, particularly, properly engineered wheels and bearings that permit relatively high speeds to be achieved.

One negative has developed, however, in that high speeds, while relatively easy to achieve, often cannot be handled by the average skater. The art of turning and/or braking from a high speed, with its inherent shift of body weight and position, is difficult to master and often results in a fall. Falls incident to turning and/or braking, are experienced by virtually every novice skater. Accordingly, a need has developed for a braking and stabilizing system that enables a skater to maintain balance at all speeds and safely slow down and/or turn.

SUMMARY OF THE INVENTION

In accordance with the present invention, a braking and stabilizing system for roller blades, hereinafter termed a "stabilizer," comprises a round hollow aluminum shaft having a roller on at least one end but preferably at opposite ends thereof. A hand brake lever is connected by a cable to a brake caliper for each roller.

In use, the skater uses the stabilizer as a balance bar in the manner of a high wire artist. Braking is accomplished by placing the roller on the end of the stabilizer against the skating surface and squeezing the brake lever, which, in turn, closes the brake caliper against the roller attenuating rotation thereof and therefore the speed of the skater.

DETAILED DESCRIPTION OF THE PREFERRED EMBODIMENT OF THE INVENTION

Figures 1, 2, 3, 4, 5:
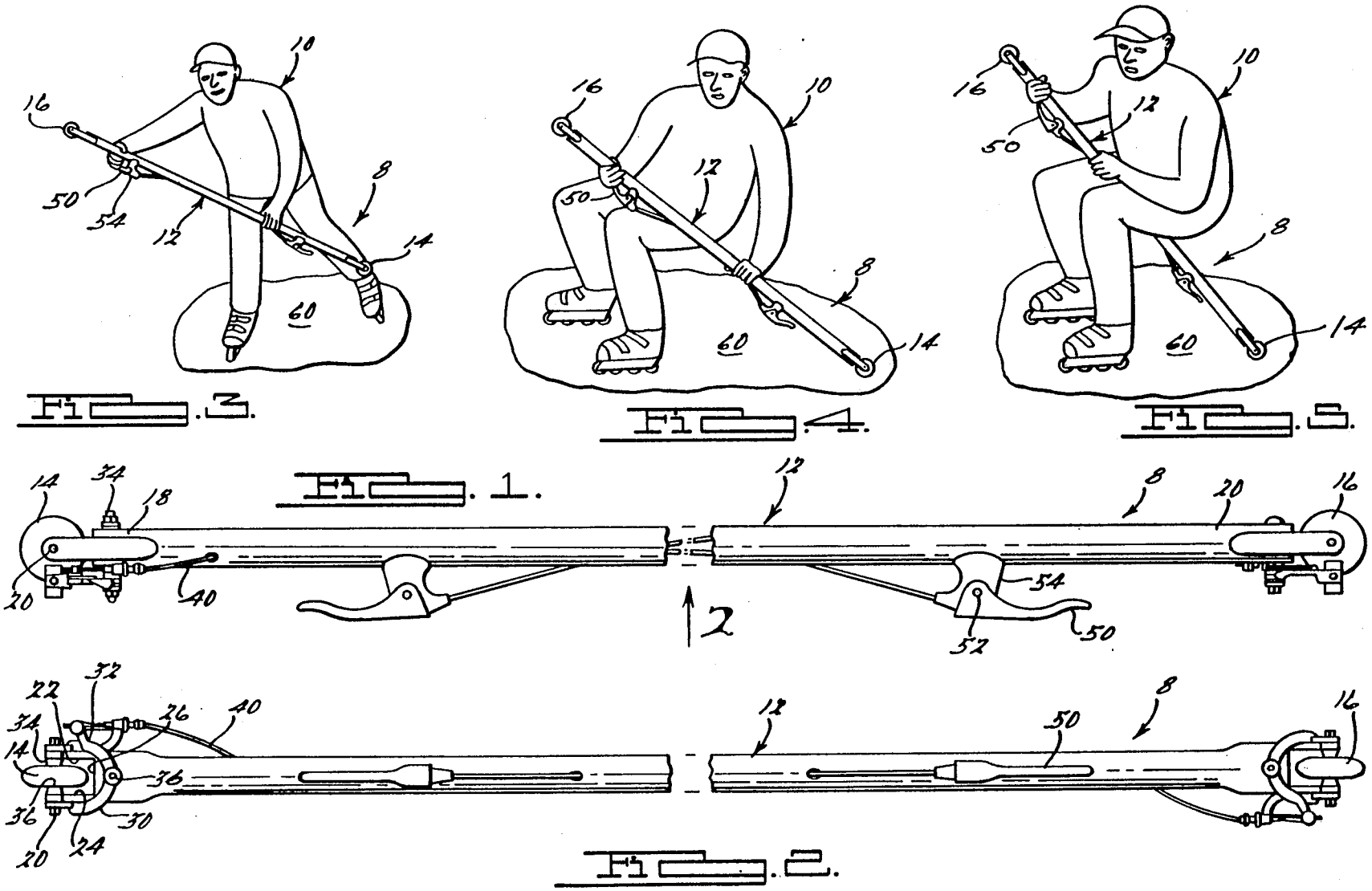
FIG. 1 is an elevational view of the stabilizer of the present invention.
FIG. 2 is a view similar to FIG. 1 taken in the direction of the arrow 2 of FIG. 1.
FIG. 3 is a view of a skater using the stabilizer of the instant invention as a balancing bar while skating.
FIG. 4 is a view of the skater of FIG. 3 using the stabilizer to effect turning or braking.
FIG. 5 is a view similar to FIG. 3 showing another mode of operation wherein the stabilizer is used as a braking mechanism.

As best seen in FIG. 1 of the drawing, a stabilizer 8, for use by a skater 10, (FIGS. 3–5), in accordance with a preferred constructed embodiment of the present invention, comprises an elongated shaft 12 preferably, a hollow aluminum extrusion, having a pair of rollers 14 and 16 at opposite ends 18 and 20 thereof, respectively. Since the rollers 14 and 16 are identical in construction, only the roller 14 and its associated braking mechanism will be discussed hereinafter, it being understood that the roller 16 and its braking mechanism is a duplicate of the roller 14 and its braking mechanism.

As best seen in FIG. 2, the roller 14 is supported on an axle 20 that extends transversely to the central axis of the shaft 12. The axle 20 is supported by opposite legs 22 and 24 of a yoke 26 at the end of the shaft 12.

A pair of brake calipers 30 and 32 having brake shoes 34 and 36 therein, respectively, are mounted on a pivot pin 37 for rotation about an axis extending laterally to the central axis of the shaft 12 and at a right angle to the axle 20. The calipers 30 and 32 are controlled by a cable 40 that extends interiorly of the shaft 12 between the calipers 30 and 32 and a hand lever 50. The lever 50 is supported for rotation, about an axis extending laterally to the central axis of the shaft 12, by a pin 52 which is journalled in a mounting bracket 54. The bracket 54 is secured to the shaft 12 by any suitable means.

As seen in FIG. 3 of the drawing, the stabilizer 8, is being used by the skater 10 as a balance bar. The stabilizer 8 has a relatively high moment of inertia enabling the skater 10 to maintain balance while negotiating a skating surface 60.

As seen in FIG. 4 of the drawing, the stabilizer 8 can be utilized by the skater 10 to effect turning and/or braking by placing the wheel 14 against the skating surface 60. Thereafter, the skater 10 merely squeezes the hand lever 50 to close the brake shoes 34 and 36 on the calipers 30 and 32 against the wheel 14 thereby creating a pivot point and/or braking forward progress of the skater 10.

As seen in FIG. 5, the stabilizer 8 can be used as a brake system by placement of the stabilizer 8 between the skater's legs.

It is to be noted that the stabilizer 8 can be used to insure against falling by placement of the wheel 14 against the skating surface 60 without effecting braking. In this mode of operation, the provision of wheels or rollers at each end of the shaft 12 constitutes a material improvement over the use of, for example, a broomstick or the like devoid of an anti-friction end construction.

While the preferred embodiment of the invention has been disclosed, it should be appreciated that the invention is susceptible of modification without departing from the scope of the following claims.

I claim:

1. A combination balance beam and braking system usable by a roller blade skater to maintain balance while skating and augment braking when it is desired to stop comprising an elongated balance beam having opposite ends of like symmetrical configuration and adapted to be manually held by the skater while skating with the opposite end thereof elevated relative to a skating surface and disposed on opposite sides of the skater, a roller on each end of said balance beam adapted to be biased against the skating surface, and lever means pivoted on said balance beam and controllable by said skater for braking rotation of each of said rollers, the weight of said rollers and lever means being orientated symmetrically on said balance beam whereby said balance beam is capable of use by a skater to maintain balance while skating.

2. A balance beam and braking system in accordance with claim 1 wherein said means comprises a brake caliper pivoted for rotation about an axis extending transversely to the longitudinal axis of said balance beam and controlled by said lever.

3. A balance beam and braking system in accordance with claim 1 wherein said lever is rotatable about an axis extending laterally of the central axis of said balance beam.

* * * * *